United States Patent [19]

Shen

[11] Patent Number: 5,071,125

[45] Date of Patent: Dec. 10, 1991

[54] RACKET

[76] Inventor: Walter Shen, No. 18, 20th Rd., Industry Park, Taichung City, Taiwan

[21] Appl. No.: 697,183

[22] Filed: May 8, 1991

[51] Int. Cl.[5] ..... A63B 49/02

[52] U.S. Cl. ..... 273/73 R; 273/73 J

[58] Field of Search ..... 273/73 R, 73 C, 73 F, 273/73 G, 73 L

[56] References Cited

U.S. PATENT DOCUMENTS

| | | | |
|---|---|---|---|
| 1,143,300 | 6/1915 | Moore | 273/73 G |
| 4,007,929 | 2/1977 | Figa | 273/73 C X |
| 4,052,060 | 10/1977 | Balkcom | 273/73 R |
| 4,367,871 | 1/1983 | Schiefer | 273/73 J X |
| 4,725,059 | 2/1988 | Du Gardin | 273/73 C X |
| 4,746,119 | 5/1988 | Jeanrot | 273/73 G X |
| 4,906,002 | 3/1990 | Goffney | 273/73 G |
| 4,915,382 | 4/1990 | Madsen | 273/73 G |

FOREIGN PATENT DOCUMENTS

| | | | |
|---|---|---|---|
| 2142265 | 3/1973 | Fed. Rep. of Germany | 273/73 G |

*Primary Examiner*—Edward M. Coven
*Assistant Examiner*—William E. Stoll
*Attorney, Agent, or Firm*—Harness, Dickey & Pierce

[57] ABSTRACT

A racket includes a substantially oval-shaped frame, a shaft, and a neck portion interconnecting the frame and the shaft. The shaft has a first portion adjacent to the neck portion and a second portion serving as a handle for the racket. The frame, the neck portion, and the first portion of the shaft are integrally made of a first material. The second portion of the shaft is made of a second material different from the first material. A layer of elastic and adhesive material is provided between respective joint end faces of the first and second portions to interconnect the first and second portions.

7 Claims, 5 Drawing Sheets

RACKET

BACKGROUND OF THE INVENTION

1. Field Of The Invention

The invention relates to a racket, more particularly to a racket having provisions to reduce vibrations at the handle thereof.

2. Description Of The Related Art

Conventional rackets, such as squash and tennis rackets, are made entirely of a single material. Examples of materials used for racket fabrication include composite materials containing graphite or glass reinforcing fibers, aluminum, etc.

When the racket is struck by a ball, the resulting impact is transmitted from the racket frame to the handle. The handle of most conventional rackets is seldom capable of absorbing vibrations and damping the impact transmitted to the user's hand. Thus, injury to the user's wrist or elbow may result if the force of impact is relatively strong.

SUMMARY OF THE INVENTION

Therefore, the objective of the present invention is to provide a racket having provisions to damp impact transmitted to the user's hand, so as to minimize the vibrations at the handle thereof.

Accordingly, the preferred embodiment of a racket of the present invention comprises a substantially oval-shaped frame, a shaft, and a neck portion interconnecting the frame and the shaft. The shaft has a first portion adjacent to the neck portion and a second portion serving as a handle for the racket. The frame, the neck portion, and the first portion of the shaft are integrally made of a first material, such as composite materials containing graphite or glass reinforcing fibers, aluminum, etc. The second portion of the shaft is made of a second material, such as rattan or polyurethane elastomers. A layer of elastic and adhesive material, such as polyurethane adhesives, is provided between respective joint end faces of the first and second portions. One of the joint end faces has a tongue projection, while the other one of the joint end faces has a socket to receive the tongue projection. The elastic and adhesive layer fastens the tongue projection in the socket to interconnect the first and second portions.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 3:
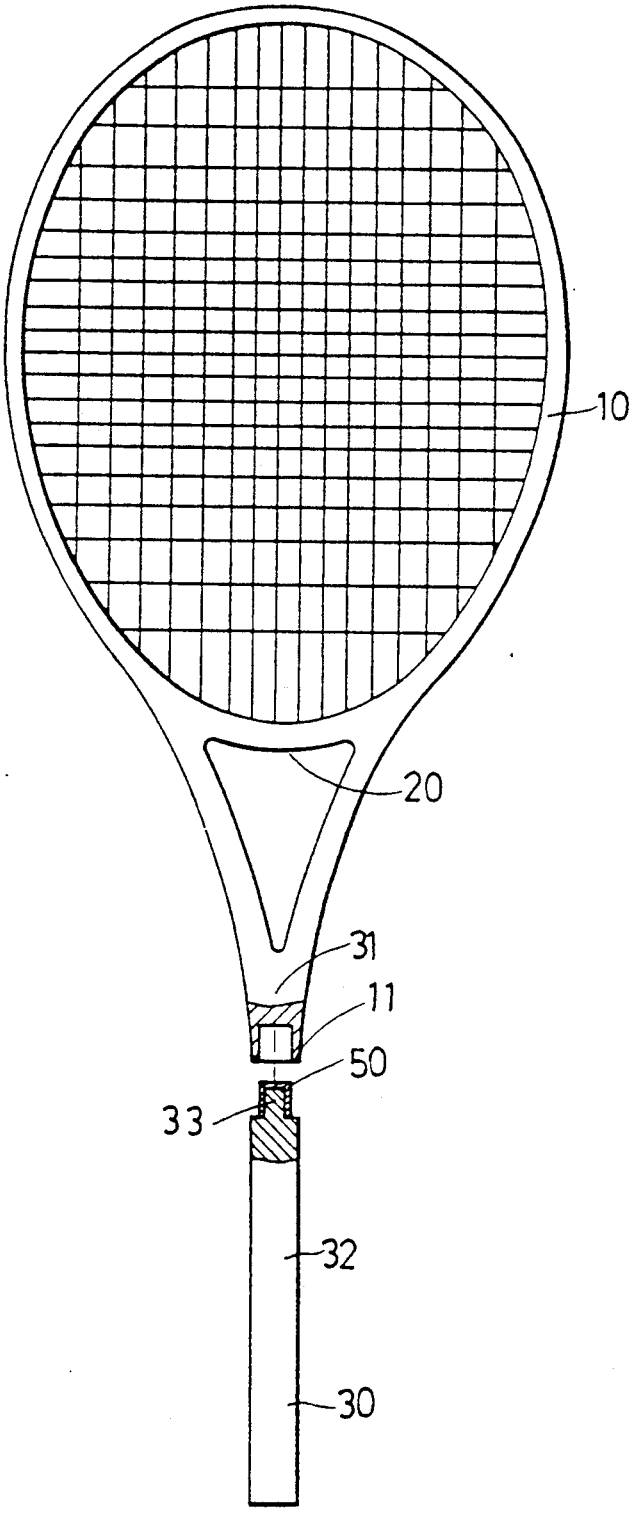
FIG. 3 is an illustration of the preferred embodiment of a racket according to the present invention.

Referring to FIG. 3, the preferred embodiment of a racket according to the present invention is shown to comprise a substantially oval-shaped frame 10, a neck portion 20 and a shaft 30. The shaft 30 has a first portion 31 adjacent to the neck portion 20, and a second portion 32 serving as a handle for the racket. The frame 10, the neck portion 20, and the first portion 31 of the shaft 30 are integrally formed and are made of a material such as composite materials containing graphite and/or glass reinforcing fibers, aluminum, etc. The second portion 32 of the shaft 30 is made of a more flexible material, such as rattan or plastic, preferably polyurethane elastomers. The second portion 32 has an upper joint end face provided with a tongue 33 which is received in a socket 11 formed on a lower joint end of the first portion 31. A layer of elastic and adhesive material 50, such as polyurethane adhesives, is provided between the tongue 33 and the socket 11. The elastic layer 50 has adhesive properties to attach the first and second portions. 31 and 32. As in conventional rackets, a layer of adhesive tape may be wrapped around the second portion 32 of the shaft 30.

Figure 1:
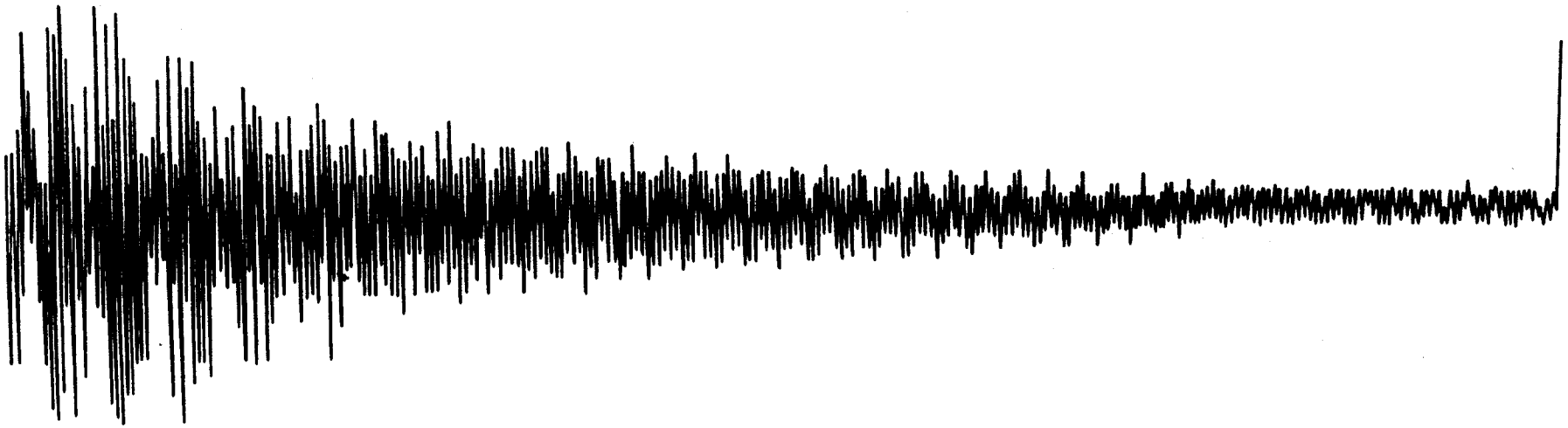
FIG. 1 PRIOR ART
FIG. 1 is a plot of the vibrations which result when a conventional racket is struck.
Figure 4:
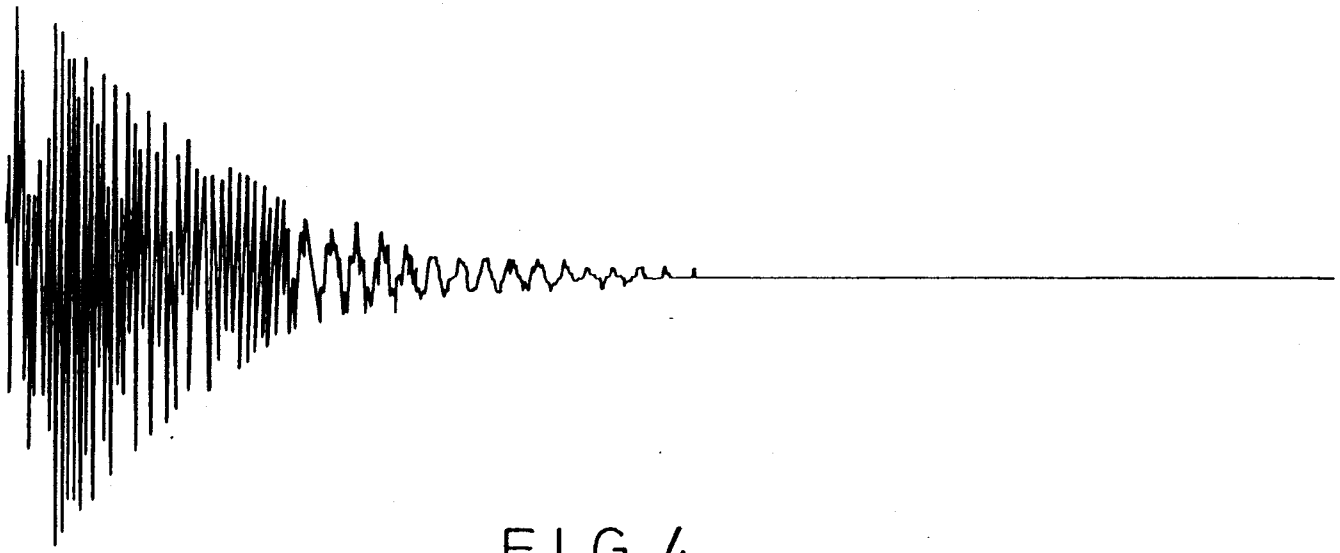
FIG. 4 is a plot of the vibrations which result when the racket of the present invention is struck.

Plots of the resulting vibrations, when a conventional racket and the racket of the present invention are struck, are shown in FIGS. 1 and 4, respectively. FIGS. 1 and 4 are plotted with the aid of a damping testing machine to ensure a high degree of accuracy. Compared to the vibrations of the conventional racket, the effective duration and the amplitude of the vibrations of the racket of the invention is much shorter, thereby minimizing the risk of injury to the user.

Figure 2:
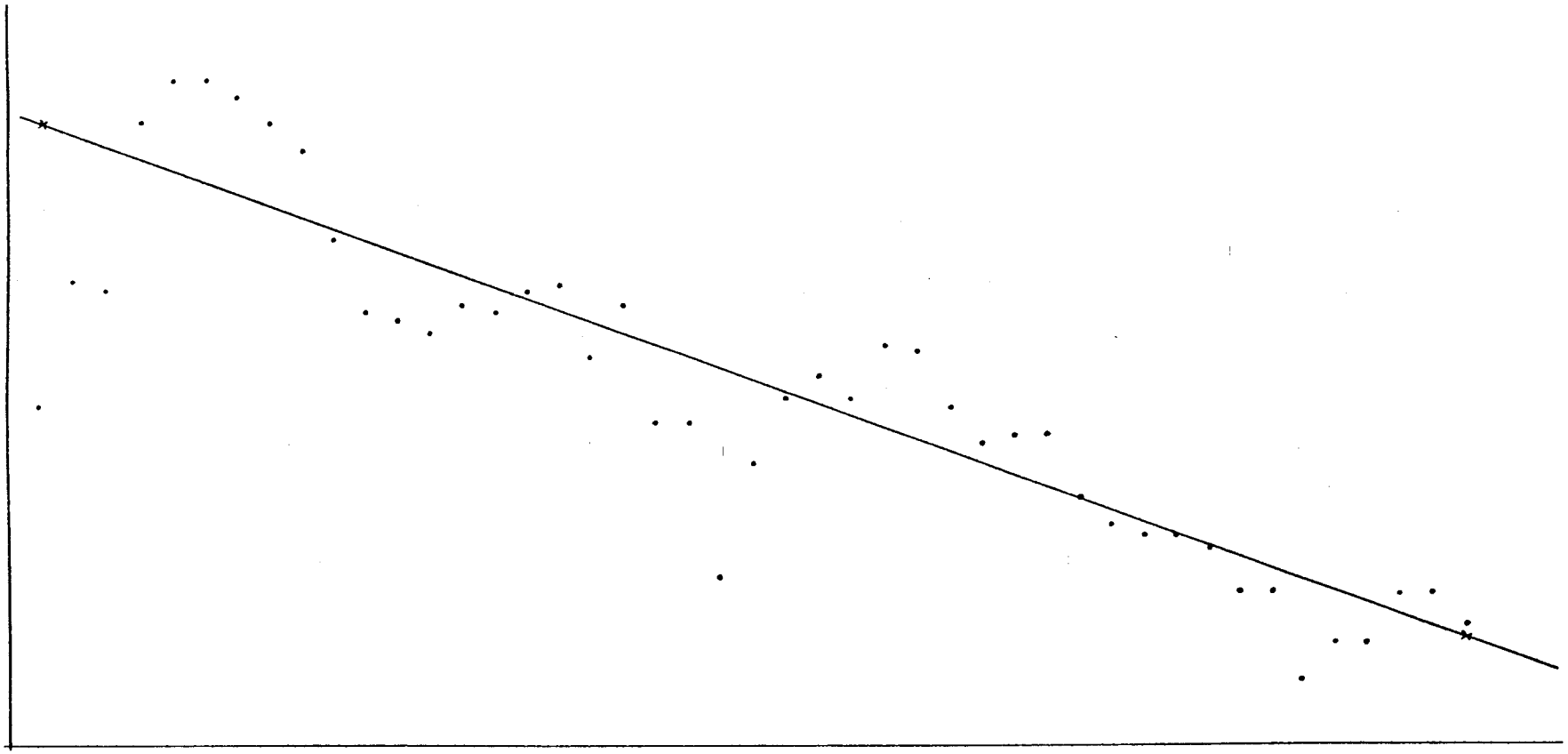
FIG. 2 PRIOR ART
FIG. 2 is a regression line obtained from the plot of FIG. 1 and used for computing the damping factor of the conventional racket.
Figure 5:
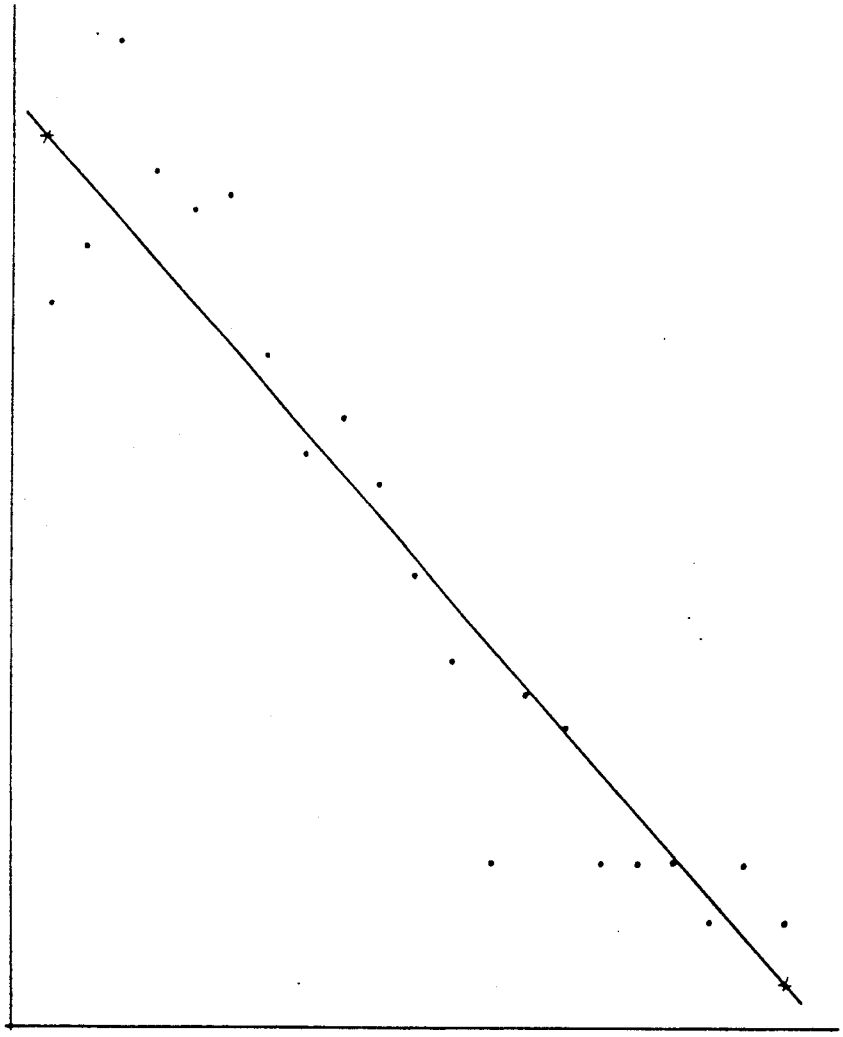
FIG. 5 is a regression line obtained from the plot of FIG. 4 and used for computing the damping factor of the racket of the present invention.

Referring to FIGS. 2 and 5, the natural logarithms of the peak-to-peak amplitudes of the vibrations plotted in FIGS. 1 and 4 are first computed in order to determine the damping factors of the conventional racket and of the racket of the present invention. The computed natural logarithms are then plotted and are used to obtain an appropriate regression line. The damping factor can then be determined from the slope of the resulting regression line. Preliminary tests show that the conventional racket has a damping factor of 34, while the preferred embodiment has a damping factor of 112, which is more than three times the damping factor of the conventional racket.

The main advantage arising from use of the racket of the present invention is that the vibrations of the shaft is minimized and the impact transmitted to the user's hand is damped, thereby minimizing the risk of injury to the user's elbow or wrist. The elastic and adhesive layer firmly connects the first and second portions of the shaft even though they are made of different materials.

While the present invention has been described in connection with what is considered the most practical and preferred embodiment, it is understood that this invention is not limited to the disclosed embodiment, but is intended to cover various arrangements included within the spirit and scope of the broadest interpretation so as to encompass all such modifications and equivalent arrangements.

I claim:

1. A racket comprising a substantially oval-shaped frame, a shaft, and a neck portion interconnecting said frame and said shaft, said shaft having a first portion adjacent to said neck portion and a second portion serving as a handle for said racket; said frame, said neck portion, and said first portion of said shaft being integrally made of a first material; said second portion of said shaft being made of a second material different from said first material; said first and second portions having respective joint end faces; said racket further comprising a layer of elastic and adhesive material provided between said joint end faces.

2. The racket as claimed in claim 1, wherein said first material is selected from the group comprising composite material and aluminum.

3. The racket as claimed in claim 2, wherein said composite material contains reinforcing fiber selected from the group comprising graphite fiber and glass fiber.

4. The racket as claimed in claim 2, wherein said second material is selected from the group comprising rattan and plastic.

5. The racket as claimed in claim 4, wherein said plastic is a polyurethane elastomer.

6. The racket as claimed in claim 2, wherein said elastic and adhesive material is a polyurethane adhesive.

7. The racket as claimed in claim 1, wherein one of said joint end faces has a tongue projection, and the other one of said joint end faces has a socket to receive said tongue projection.

* * * * *